US005171178A

United States Patent [19]

Creek et al.

[11] Patent Number: 5,171,178

[45] Date of Patent: Dec. 15, 1992

[54] PERSONAL FLOTATION DEVICE

[76] Inventors: Wilson Creek, 717 SW. 2nd St., Ontario, Oreg. 97914; Peter L. Ross, 385 Rose Ave., Chico, Calif. 95928

[21] Appl. No.: 577,502

[22] Filed: Sep. 4, 1990

[51] Int. Cl.[5] ..... B63B 35/78

[52] U.S. Cl. ..... 441/132

[58] Field of Search ..... 441/129-132, 441/109, 110, 111; 114/351, 345

[56] References Cited

U.S. PATENT DOCUMENTS

| | | | |
|---|---|---|---|
| D. 139,176 | 10/1944 | Gaide | D15/1 |
| D. 290,108 | 6/1987 | Wolfe | D12/316 |
| 1,996,576 | 4/1935 | Hegewaldt | 441/130 |
| 2,529,961 | 11/1950 | Phillips | 441/131 |
| 2,803,839 | 8/1957 | Mosely | 9/11 |
| 2,980,927 | 4/1961 | Waters, Sr. | 9/347 |
| 3,432,868 | 3/1969 | Lowery | 441/111 |
| 3,490,085 | 1/1970 | Lewis | 114/345 |
| 4,606,728 | 8/1986 | Simpson | 441/66 |
| 4,973,278 | 11/1990 | Williams | 441/131 |

FOREIGN PATENT DOCUMENTS

| | | | |
|---|---|---|---|
| 105737 | 7/1924 | Switzerland | 441/132 |

*Primary Examiner*—Sherman Basinger

*Attorney, Agent, or Firm*—Frank J. Dykas; John P. O'Banion

[57] ABSTRACT

A floatation device (10) for sportsmen which includes a U-shaped flotation tube assembly (11) having a pair of opposing parallel legs (12 & 14) which are encased by a fabric outer covering (20) and has attached thereto a flexible seating platform (18). Flexible seating platform (18) is attached to outer covering (20) so that it is suspended between opposing parallel legs (12 & 14) of the U-shaped floatation tube assembly (11). Tensioning strap 22 spans the outer perimeter of the U-shaped floatation tube assembly and attaches to the ends of the opposing legs for preventing the legs from collapsing toward each other when weight is applied to the flexible seating platform. The flexible outer covering (20) has a zippered access hole (32) whereby the U-shaped floatation tube assembly (11) may be introduced and inflated so that the U-shaped floatation tube assembly (11) fills out outer covering (20) and provides buoyancy for a sportsman on water.

2 Claims, 6 Drawing Sheets

PERSONAL FLOTATION DEVICE

BACKGROUND OF THE INVENTION

1. Technical Field.

This invention generally relates to personal flotation equipment for fishing and more particularly it relates to a specific configuration of flotation devices known as float tubes used for hunting and fishing.

2. Background Art

The sport of fishing has been around since the dawn of man. Unfortunately, so has the problems of getting to the biggest and the best fish. Traditionally, one of the preferred methods has always been to use a boat. However, fishermen discovered that many rivers and lakes had no access points or had only a limited number of access points in which a man with a boat could use. Fishermen can only walk or wade so far and as a result a great deal of water remained relatively unfished. Therefor fishermen began to develop personal flotation equipment for fishing. These personal flotation devices were designed to take a fisherman to hard to reach areas of lakes and streams. They were also designed to be portable for transport to possible fishing sites in remote areas.

One of the advantages of fishing from a float tube is the mobility it provides the fisherman. The float tube can reach areas of lakes and streams which are unreachable by conventional means and the float tube provides almost unlimited access to any lake or stream.

Prior art personal flotation devices having buoyancy to support the user include a wide variety of flotation structures, such as chairs, rafts, ring tubes, etc. WATERS, U.S. Pat. No. 2,980,927, teaches a chair-like, U-shaped structure in which a bather may recline or paddle about in the water. This invention, however, employs a rigid seat which is suspended from the U-shaped buoyancy chamber. Also, there is a rigid metal rod which runs through the middle of the buoyancy chamber on this particular invention to help keep the U-shape to the buoyancy chair.

MOSLEY, U.S. Pat. No. 2,803,839, teaches a buoyant chair which supports the occupant in a semi-reclining position in a swimming pool or other body of water where people swim or bathe. This device, however, is extremely bulky and would be difficult to transport over rough terrain to different remote areas.

WOLFE, Des. 290,108, and GAIDE, Des. 139,176, both teach floatable chairs. However, the above flotation devices are obviously inflatable pool toys not designed to withstand the rigors of lake and stream hunting and fishing.

SIMPSON, U.S. Pat. No. 4,606,728, teaches a water ski aid for supporting a water skier and is designed to be towed behind a boat. This invention utilizes a sand or water ballast to provide stability when being pulled over the water.

The most common float tube for fishermen (see FIG. 1) is made with a ring-shaped air bladder, typically an inner tube from an automobile, which is placed inside of a shroud-like fabric outer covering. The outer covering fits around the inner tube very closely, forming a tight glove-like fit when the air bladder is inflated. A plurality of straps are attached to and suspended from the inside diameter of the outer covering (see FIG. 1) thus forming a generally triangular shaped crotch type seat within the center of the innertube where the fisherman sits.

The fisherman normally wears a pair of rubberized watertight pants commonly known as waders and a pair of swimming fins for propelling the flotation device in the desired direction.

One problem with this particular float tube is the triangle shaped crotch seat. This seat is difficult to get into and out of with swim fins on since the fins tend to get caught in the straps of the crotch seat.

The design of the seat of this float tube also promotes undue wear of the waders due to the presence of the crotch strap in the front of the seat (see FIG. 1). This becomes a serious problem if a hole should develop in the waders allowing water to enter the waders. This could make it extremely difficult getting out of the water or maneuvering if the waders should fill with water.

Another major problem with this type of float tube is getting into and out of the water. The recommended method is to put on waders and swim fins while still on dry land, step into the float tube and work the swim fins past the straps of the crotch seat and then raise the tube to a position around the waist. The fisherman then backs into the water. This proves to be a very difficult and potentially dangerous task. To trip or fall into deep water, mud, or onto a hard, rocky bottom could be catastrophic.

This float tube is also very difficult to extricate oneself from while in the water. Should the fisherman snag himself on underwater obstructions and tear the waders, it would be very difficult to get out of the tube before the waders filled with water. Thus, emergency exits from this float tube are difficult.

Another difficult task associated with the prior art float tube is to reattach a swim fin if it falls off. Normally, the fisherman either has to reach over the side of the float tube to adjust or replace the swim fin or reach down through the leg holes in the float tube, bend the leg up and reattach the fin. Reaching forward over the side of the float tube changes the stability of the tube making it possible to tip the unit upside down and the latter method is a difficult maneuver in itself.

Another inherent problem with the circular shape of the prior art (see FIG. 1) is the position the fisherman is placed in when propelling the tube. The ring or circular shape of the prior art float tube restricts movement of the fisherman's legs due to the presence of part of the tube directly in front of him. Since the fisherman is forced to maintain a predominantly upright position, much of the propulsion force is wasted in upward thrust. These prior art float tubes are difficult to maneuver for any distance.

There are construction or fabrication problems with the prior art. Because of the ring shape of the prior art float tube, it is necessary to secure the outer covering around the tube utilizing a zipper which extends around the entire inner circumference of the float tube. This presents a problem in that long zippers are oftentimes damaged due to overinflation.

Accordingly, it is an object of the present invention to provide a new and improved air inflatable, portable flotation device which is easier, safer, and faster to get into and get out of. Also needed is a flotation device which is easier and safer to get into the water. Also needed is a float tube that provides a greater range of leg motion without changing the stability of the flotation device therefore making it easier to make necessary adjustments to equipment, and to provide for an easier, more efficient method of propelling the flotation device through the water. It is a further object of the present invention to provide a means for securing the flexible outer covering around the float tube which is more durable and less susceptible to damage due to overinflation. It is therefor an object of the present invention to provide a flotation device that satisfies these needs.

DISCLOSURE OF INVENTION

These and other objects are accomplished by a flotation device which utilizes an air inflatable flotation tube assembly having a pair of opposing parallel legs which are formed integral with a back or rear flotation tube section and forming a general U-shape. This U-shaped flotation tube assembly is encased by a fabric outer covering. A flexible seating platform is attached to and suspended between the opposing parallel legs of the U-shaped flotation tube assembly. A tensioning strap spans the outer perimeter of the U-shaped flotation tube assembly and attaches to the ends of the opposing legs for preventing the legs from collapsing toward each other when weight is applied to the flexible seating platform.

An emergency flotation tube which serves a dual function as a back rest is also provided and attached to the back or rear section of the U-shaped flotation tube assembly.

Also provided are shoulder carrying straps for transporting flotation device to remote areas.

The U-shape configuration also permits the use of a shorter flotation tube assembly access hole because each of the opposing legs of the U-shaped flotation tube assembly can be placed into the access hole and then slid into the sleeve-like cavities of the fabric outer covering. This significantly reduces the tensional stresses on the access hole and improves the integrity of the entire assembly.

BEST MODE FOR CARRYING OUT INVENTION

Figure 1:
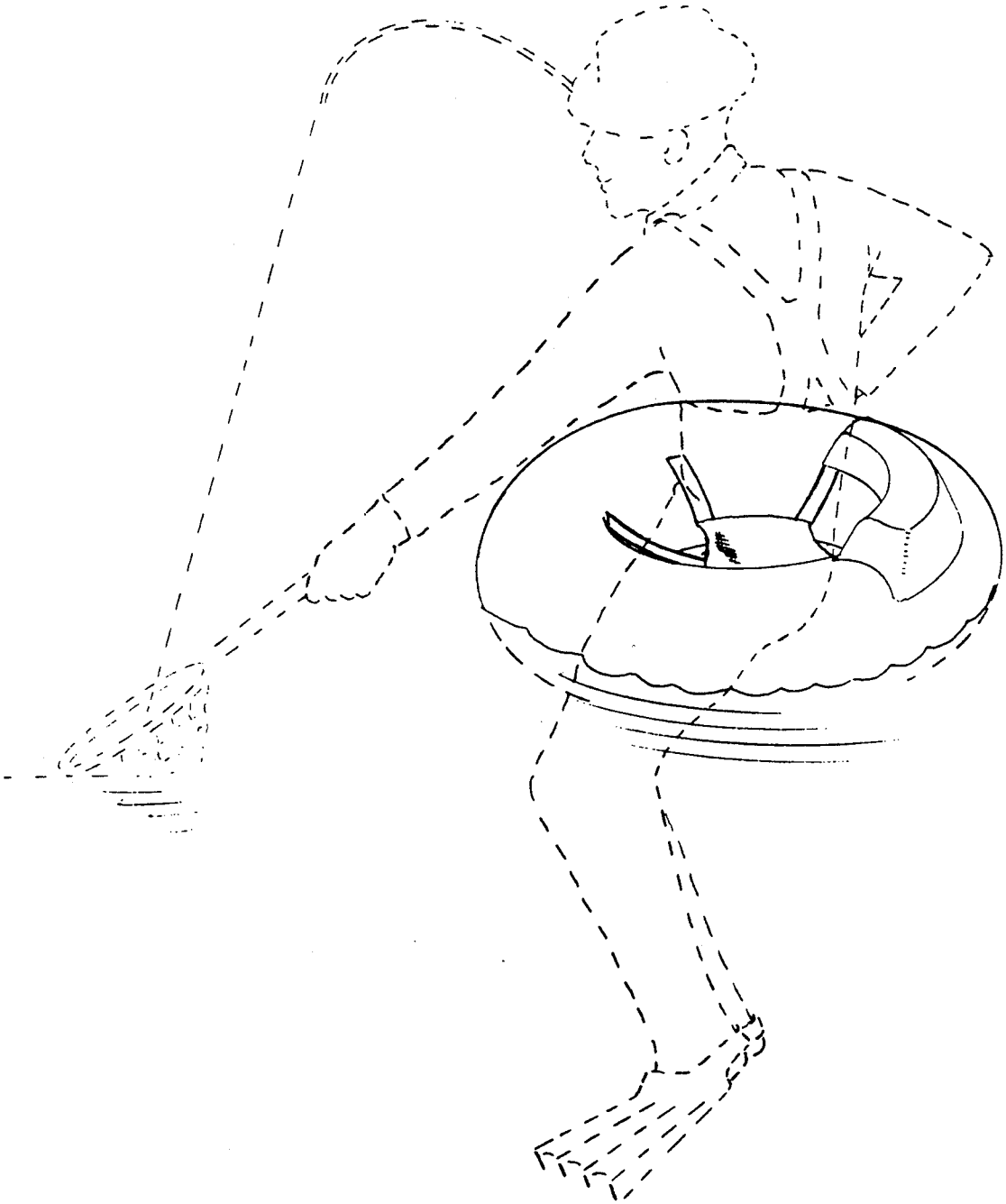
FIG. 1 (PRIOR ART)
FIG. 1 is a perspective representational view of prior art float tube with fisherman.
Figure 2:
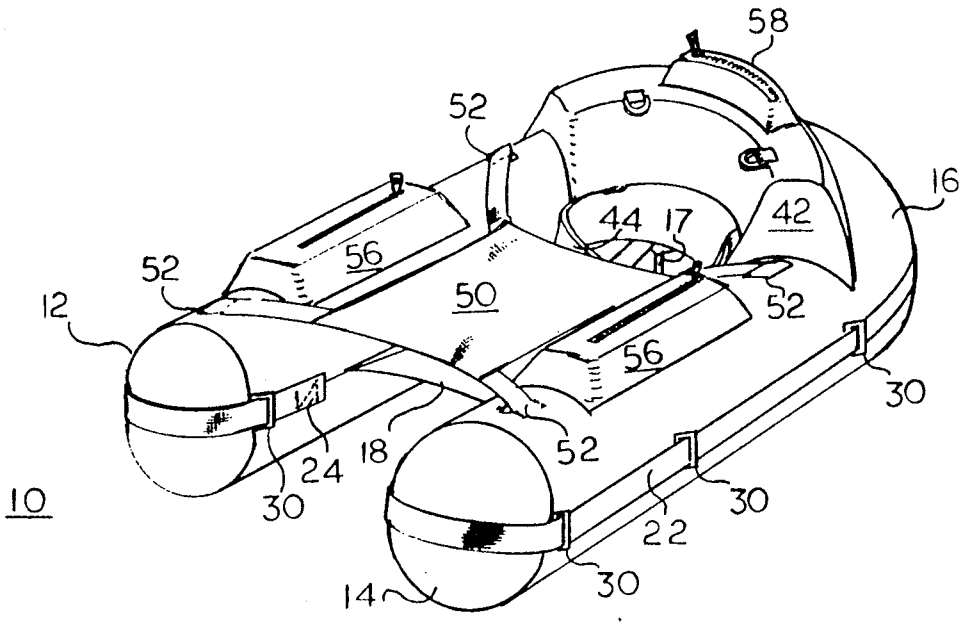
FIG. 2 is a perspective representational view of the new flotation device.
Figure 3:
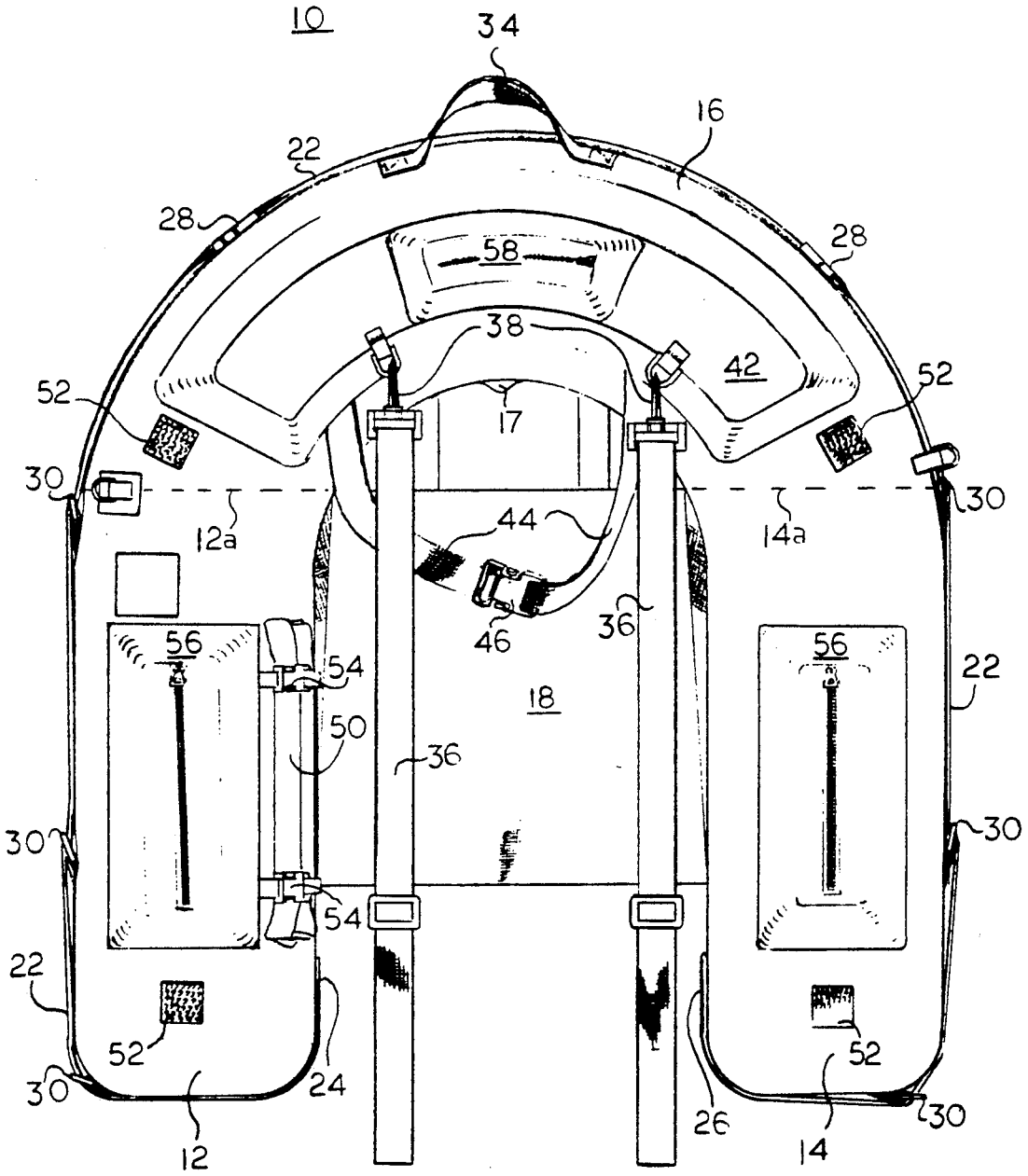
FIG. 3 is a top view of flotation device.

Referring to FIGS. 2 and 3, personal flotation device, generally designated as 10, is shown. The U-shaped flotation tube assembly can be generally divided into three distinct sections being first parallel flotation tube leg 12 and second parallel flotation tube leg 14 and back or rear flotation tube section 16. First and second parallel flotation tube legs 12 & 14 are attached to, and in the preferred embodiment, formed integral with back or rear flotation tube section 16, along hatched lines generally designated as 12*a* and 14*a*. Thus is formed a U-shaped flotation tube assembly which is open at the front and closed at the rear.

As shown in sectional side view (FIG. 4), the U-shaped flotation tube assembly 11 is covered or completely encased within an outer covering 20 which, in the preferred embodiment, is fabricated of nylon and can be provided with a variety of different color schemes with the most common being a mottled green and brown camouflaged design.

Figure 4:
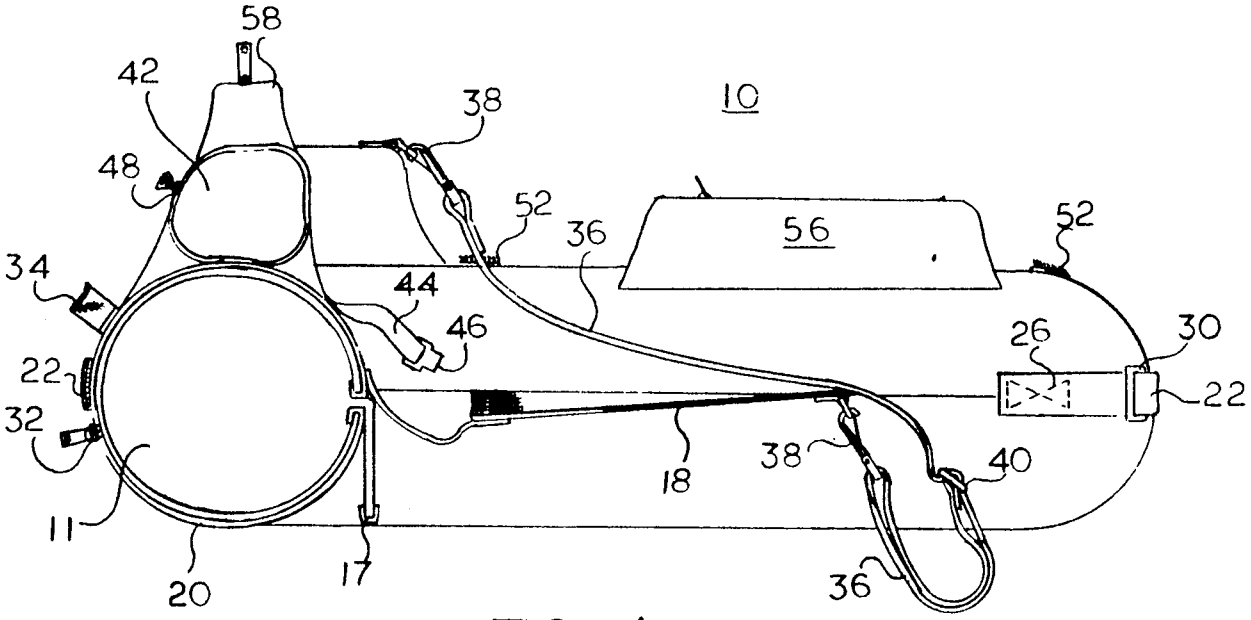
FIG. 4 is a sectional side view of flotation device.
Figure 5:
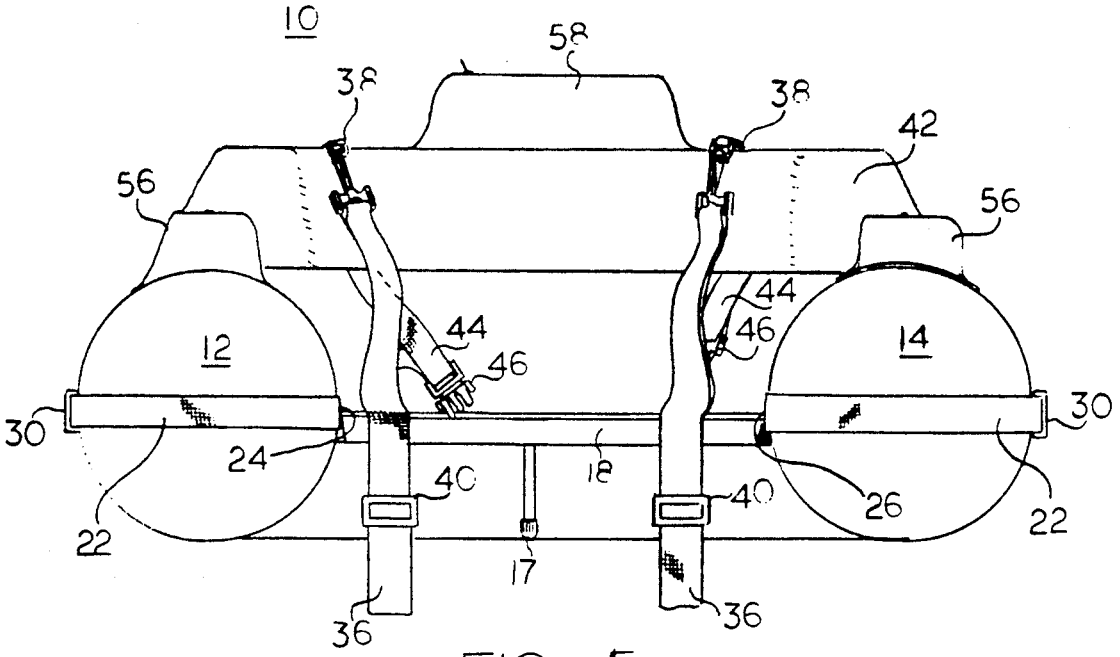
FIG. 5 is a front view of flotation.
Figure 6:
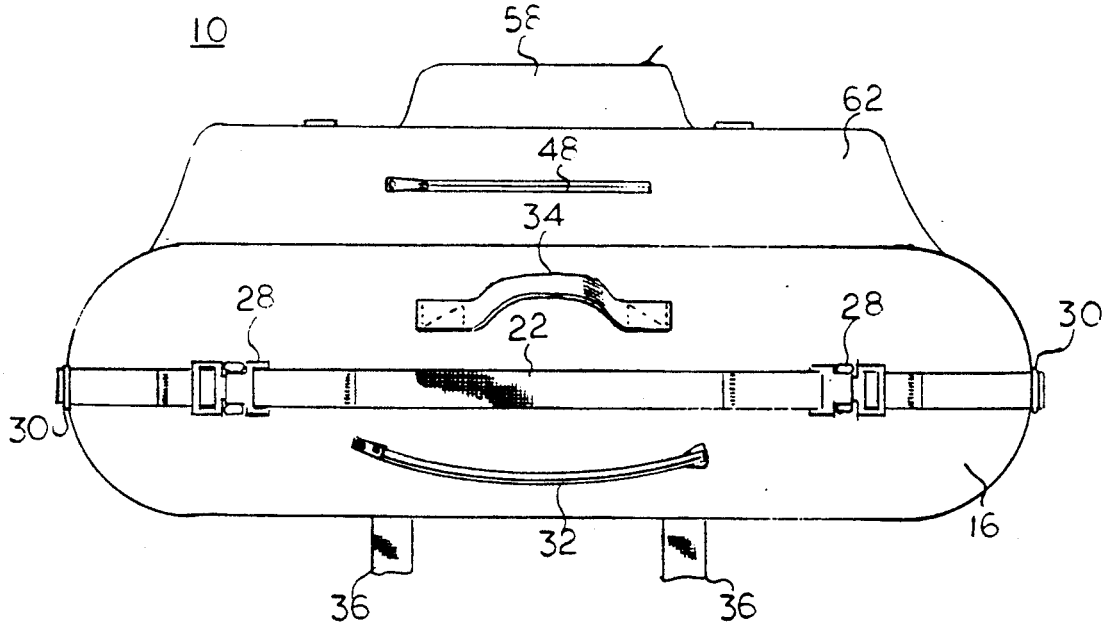
FIG. 6 is a rear view of flotation device.
Figure 7:
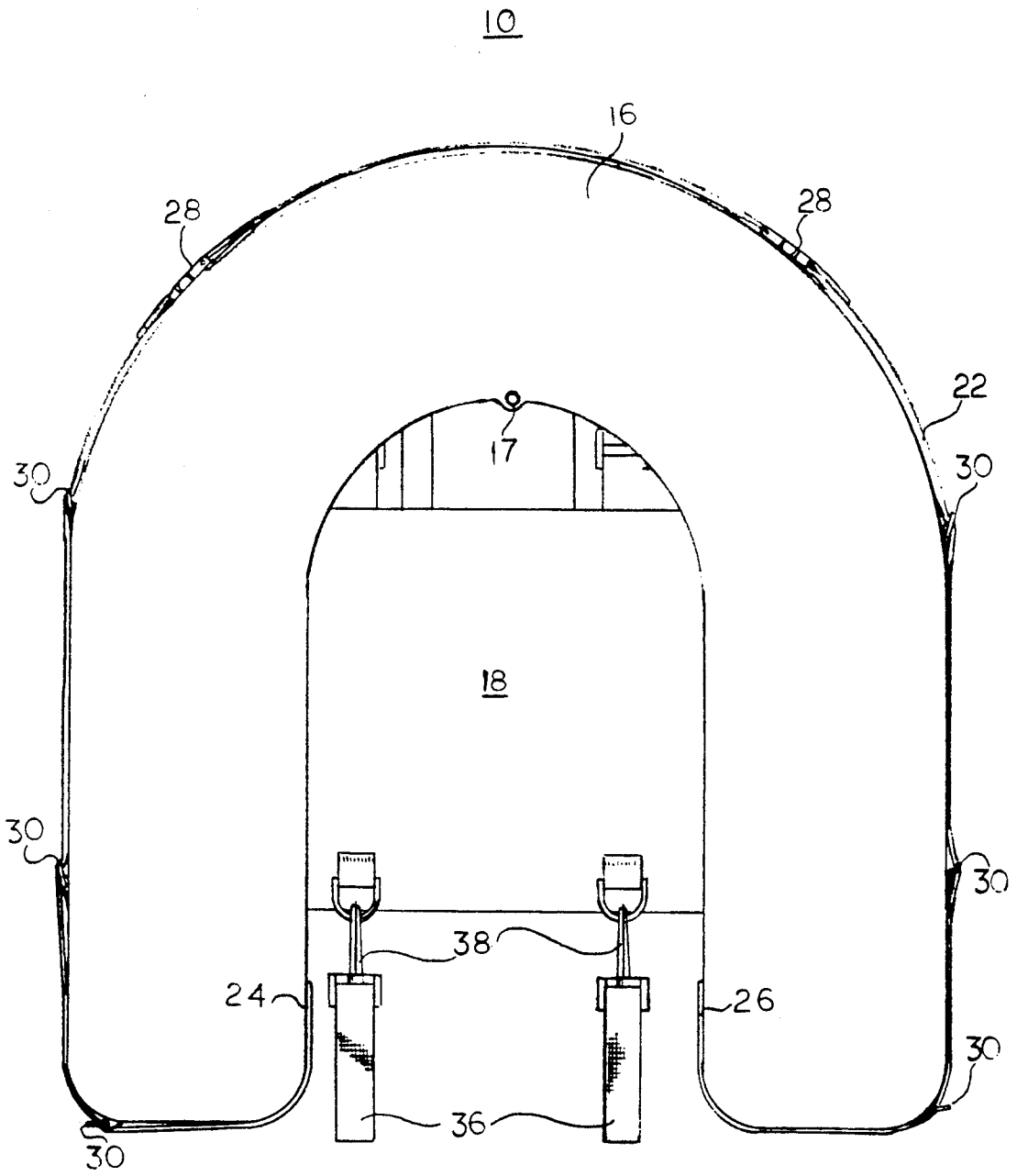
FIG. 7 is a bottom view of flotation device.

To prevent first and second parallel flotation tube legs 12 & 14 from collapsing toward each other when the user sits on flexible seat 18, tensioning strap 22 is provided (FIGS. 2–7). Tensioning strap 22 is sewn onto the outer covering 20 at strap attaching points 24 and 26 which are each, respectively, indicated on the inner surfaces of parallel flotation legs 12 and 14 near the front ends of said flotation tube legs (FIGS. 3, 4, 5, and 7). The strap then wraps snugly around the outer perimeter of U-shaped flotation tube assembly 11 from the attachment points 24 and 26 (FIGS. 3, 5, 7). Tensioning strap 22 is actually formed of three separate pieces which are interconnected by means of adjustment buckles 28 (FIGS. 3, 6, 7) to provide a tensioning force to the outer perimeter of U-shaped flotation tube assembly 11 thereby enabling the user to adjust the tension holding the first and second parallel flotation tube legs 12 and 14 apart. Thus the user can adjust the tension to maintain first and second flotation tube legs parallel for the particular weight of that particular user. Tensioning strap 22 is only used to prevent flotation tube legs 12 and 14 from collapsing in toward each other. Regardless of the amount of tensioning force imparted to strap 22, parallel flotation tube legs 12 and 14 are prevented from expanded out away from each other by reason of their being attached to flexible seat 18 which holds them together. Tensioning strap 22 is held in position around the outer perimeter of U-shaped flotation assembly 11 by means of a plurality of tension strap loops 30 as is shown in FIGS. 2–7.

As previously described in the background section of this specification, one of the major advantages of using the U-shaped flotation tube assembly 11 is that it eliminates the need for a long perimeter zipper or other fastening device for outer covering 20. In the preferred embodiment, the U-shaped flotation tube assembly 11, when deflated, can be entirely inserted into outer covering 20 through zippered access hole 32 (FIG. 6). Zippered access hole 32 can be much smaller because of the U-shaped design. This significantly reduces the tensional stresses on zippered access hole 32 and improves the integrity of the entire assembly.

Valve stem 17 (FIGS. 2, 4, 5, 7) is provided for injecting air into the U-shaped flotation tube assembly 11 and is located on the interior surface of the back or rear flotation tube section 16 where it is out of the way, unobtrusive, and protected from impact or damage during transport or use of personal flotation device 10. Outer covering 20 is provided with an access hole, not shown, through which valve stem 17 extends.

In use, one of the primary advantages of personal flotation device 10 over the prior art is that the fisherman does not wear the flotation device as one would in the prior art as described in the specification, but rather sits upon flexible seating platform 18. Access to flexible seating platform 18 is greatly facilitated by the U-shape flotation tube assembly 11. All the fisherman has to do is inflate U-shaped flotation tube assembly 11 and emergency flotation chamber 42, place flotation device 10 in the water, wade into the water a few inches, and sit down on flexible seating platform 18.

The fisherman is most likely wearing rubberized, chest high waders, and a set of swim fins. The fisherman will place the personal flotation device 10 on the water and then sit down on it. This is much safer in that the fisherman is not wearing the flotation device such as described in the prior art nor is the fisherman attached to it. Thus, if the fisherman were to slip and fall, his or her arms and hands would be free and unobstructed so as to break the fall or otherwise avoid harming themselves.

Once the fisherman is seated on personal flotation device 10 the fisherman's legs and feet are not obstructed by any flotation structure and as a result the fisherman is free to kick or paddle his legs in a much more normal and natural manner to propel himself or herself around in the water.

Safety strap 44, equipped with quick release buckle assembly 46 (FIGS. 2–5) is provided as a safety feature to hold the fisherman on flexible seating platform 18. In practice, it has been found that it is best if the fisherman fastens safety strap 44 around his waist so as to eliminate the potential of inadvertently falling out of personal flotation device 10. However, the fisherman is still in a position to quickly release the safety strap in the event that the flotation device 10 were to tip over or to otherwise drift into harms way. This quick release feature is also particularly important in circumstances where the protective waterproof clothing, namely the chest high waders being worn by the fisherman were to spring a leak. Fisherman whose waders have filled with water are likely to sink to the bottom unless they can separate themselves from the waders. As previously stated in the prior art section, this is very difficult to do in other float tubes which are worn by the fisherman, since the fisherman must first get rid of the float tube and then get rid of the flooded waders. In the present invention, separating oneself from personal flotation device 10 is simple and quick.

Also, as previously described in the specification, the personal flotation device 10 must be capable of being transported from a vehicle to a remote fishing sight. In the preferred embodiment there are two methods by which this can be accomplished, the first being simply by use of carrying handle 34 (FIGS. 3, 4, 6), the other, by means of shoulder straps 36 as shown in FIGS. 3, 4, 5, and 7. Shoulder straps 36, as shown in FIGS. 3, 4, 5, and 7, are provided with quick release fastening clips 38 and adjustment buckles 40 to facilitate carrying, in a backpacking fashion, personal flotation device 10 for extended distances. Shoulder straps 36 are removed from personal flotation device 10 prior to its in-water use.

For safety's sake, personal flotation device 10 is provided with emergency buoyancy chamber 42 as shown in FIGS. 2–6 which serves a dual function, both as an emergency flotation tube and as a backrest for the fisherman. Emergency flotation tube 42 is independent of U-shaped flotation tube assembly 11 and is inserted into outer cover 20 through emergency flotation tube zippered access hole 48 (FIG. 6). Although it is not shown in the drawings, however, emergency tube 42 is provided with a conventional valve stem which can either be covered by outer cover 20, or extend out through a suitable opening as the case may be.

When in use, the fisherman is seated on flexible seat 18 with his or her back against the inner portion of back or rear section 16 of U-shaped flotation tube assembly 11 and resting against emergency flotation tube 42. The seat 18 itself is inclined downward to the back at approximately a 5° to 10° incline as shown in FIG. 4. This provides an additional measure of safety in holding the user in place on float tube 10. In this position, movement of the fisherman's legs is unrestricted thus enabling the fisherman to paddle his or her legs in a much more natural position to propel personal flotation device 10 around in the water.

A real advantage to personal flotation device 10 is that it provides for a detachable work surface 50 as shown installed in FIG. 2, which is formed of a flexible fabric and is capable of being rolled up and held by means of worksurface storage straps 54 (FIG. 3). Detachable worksurface 50 spans across the upper surfaces of first and second parallel flotation tube legs 12 and 14 in lap top table like fashion when in use. A variety of attachment means can be utilized to hold worksurface 50 in position, however, in the preferred embodiment the attachment device is a common variety of hook and loop fastening fabric with patches of said fabric positioned on flotation tube assembly 11 on the corresponding corners of worksurface 50, and shown in FIGS. 2–4 as attachment points 52.

Back storage pouch 58 and side storage pouches 56 are provided for the convenience of the fisherman (FIGS. 2–6).

Since the U-shaped flotation tube assembly 11 is formed of conventional rubberized materials, and is manufactured with no rigid structural members, the U-shaped flotation tube assembly 11 and emergency flotation tube 42 (FIGS. 2–6) can be deflated while still within outer cover 20, and rolled up or folded into a compact size for convenient storage. This is significant in that it enables the fisherman to transport personal flotation device 10 on a plane, in a small carrying case, or even in luggage.

While there is shown and described the present preferred embodiment of the invention, it is to be distinctly understood that this invention is not limited thereto but may be variously embodied to practice within the scope of the following claims.

I claim:

1. A float tube for use by fishermen, hunters or the like which comprises:

a generally U-shaped flotation tube assembly having two parallel opposing legs formed integral with a back or rear section;

a flexible seating platform attached to and spanning between the two parallel opposing legs;

a tensioning strap spanning the outer perimeter of the U-shaped flotation tube assembly, formed of a plurality of separate pieces which are interconnected by means of adjustment buckles, and snugly attached to each of the parallel opposing legs for positioning the opposing legs relative to each other;

a flexible outer covering for encasing the U-shaped flotation tube assembly;

a detachable worksurface spanning between and releasably attached to the opposing legs in juxtaposed relationship to the flexible seat;

a releasable safety belt;

shoulder carrying straps; and a combination backrest and emergency flotation tube.

2. The float tube of claim 1 which further comprises a plurality of storage pouches.

* * * * *